US005685740A

United States Patent [19]

Lim

[11] Patent Number: 5,685,740

[45] Date of Patent: Nov. 11, 1997

[54] SHIELDED ELECTRICAL CONNECTOR

[75] Inventor: Gunsang Lim, Cordova, Tenn.

[73] Assignee: Thomas & Betts Corporation, Memphis, Tenn.

[21] Appl. No.: 530,803

[22] Filed: Sep. 20, 1995

[51] Int. Cl.[6] ..... H01R 13/648

[52] U.S. Cl. ..... 439/610; 439/607

[58] Field of Search ..... 439/607–610, 439/108, 101

[56] References Cited

U.S. PATENT DOCUMENTS

| | | | |
|---|---|---|---|
| 5,046,967 | 9/1991 | Majernik et al. | 439/610 |
| 5,195,909 | 3/1993 | Huss, Jr. et al. | 439/610 |
| 5,244,415 | 9/1993 | Marsilio et al. | 439/610 |

FOREIGN PATENT DOCUMENTS

| | | | |
|---|---|---|---|
| 9410723 | 5/1994 | WIPO | 439/610 |

*Primary Examiner*—Hien Vu

*Attorney, Agent, or Firm*—Michael L. Hoelter; Salvatore J. Abbruzzese

[57] ABSTRACT

An electrical connector for terminating electrical conductors of a multiconductor cable comprises an electrically insulative housing defining an passage for receipt of an electrical connector plug and an open interior compartment, a plurality of electrical contacts supported in the housing, the contacts having first portions accessible through the housing passage and second IDC portions resident in the compartment, an electrically conductive sheet member fully circumscribing a part of the housing in which the contact first portions are resident and partly circumscribing the compartment and a stuffer member closing the compartment and dressing electrical conductors into engagement with the contact second IDC portions. The stuffer member has an electrically conductive part in electrical continuity with the sheet member and a stuffer part, the stuffer part being comprised of electrically insulative material, the stuffer member and the sheet member defining structures jointly operating to provide strain relief for the cable. The stuffer member and the sheet member define further structures jointly operating to provide electrical continuity between the cable shield and each of the stuffer member and the sheet member.

11 Claims, 6 Drawing Sheets

SHIELDED ELECTRICAL CONNECTOR

FIELD OF THE INVENTION

This invention relates generally to electrical connectors for terminating multiconductor electrical cables and pertains more particularly to terminating shielded multiconductor cables and for continuing cable shielding through the connector and the connection interface.

BACKGROUND OF THE INVENTION

FIG. 1 depicts an electrical connector jack (receptacle) which is commonly known by the standard designation "RJ45". Referring to FIGS. 1–3, RJ45 connector jack 10 is adapted to terminate multiconductor cable 12, which has individual electrical conductors 14. Reference numeral 16 identifies a so-called "stuffer member" or "dressing block", the upper undersurface of which defines conductor-retaining undulations 16*a*, which maintain the conductors in position for insulation displacement connection (IDC) with electrical contacts, and latching detents 16*b*. The conductors are extended from cable 12, e.g., by removing outer insulation thereof, by peeling back inner cable shield braiding and by untwisting the insulated conductors to lay them flat in undulations 16*a*. The conductors are trimmed from their condition shown in FIG. 2 such that they are conterminous with the leftward end of undulations 16*a*.

So loaded with the insulated conductors, stuffer member 16 is inverted and disposed as is illustrated in FIG. 3, which illustrates a further component of the connector jack, namely, housing 18. Housing 18 defines connector plug-receiving passage 18*a*, top-open compartment 18*b* and latches 18*c*. Electrical contacts 20 are supported in housing 18 and have spring portions cantilever-disposed in passage 18*a* and IDC portions (not shown), which are disposed at the leftward end of compartment 18*b*.

Upon forcible insertion of stuffer member 16 into housing compartment 18*b*, the IDC portions of contacts 20 terminate conductors 14. Latches 18*c* snap retentively about latching detents 16*b* to secure the jack connector assembly.

The jack connector of FIGS. 1–3 is not a shielded assembly. Thus, the jack connector and the connection interface, i.e., when a plug connector is inserted into passage 18*a*, are not afforded electromagnetic interference (EMI) protection. This type of protection is highly desired, indeed, imperative, in various present day digital communication systems.

While countless approaches are seen in prior art patents and in commercially-available connector products to provide connector jacks, such as the RJ45, with EMI protection, the approach of most relevance to the subject invention is seen in the showings of FIGS. 4 and 5, which show respective components of a composite EMI shield in a connector jack of the RJ45 type sold commercially by the assignee of the subject application.

In FIG. 4, sheet metal member 24 has a box-like portion 24*a*, having interiorly-directed lip 24*b*, resident aside passage 24*c*. A rearward deck 24*d* has latches 24*e* upstanding therefrom and contact leaf 24*f*.

In FIG. 5, stuffer member 22 is constituted principally by a body of electrically insulative material. The body has an uncoated part 22*a*, defining the undulations for conductor retention, but the remnant of the body is coated with an electrically conductive substance or substances applied in successive layers.

In assembling such commercially-available connector, housing 18 with contacts 20 therein is inserted into sheet member 24 of FIG. 4, latches 24*e* becoming superimposed on latches 18*c*. Then, stuffer member 22 of FIG. 5 is forcibly inserted onto rearward deck 24*d* of sheet member 24, whereupon the events above discussed for FIGS. 1–3 occur, i.e., the conductors are terminated in IDC manner and the latches 18*c* engage latching detents 22*b*. Further, contact leaf 24*f* engages the undersurface of stuffer member 22 to provide electrically conductivity between the sheet member and the stuffer member, which function, in effect as cooperative components of a composite EMI shield.

While the commercial product of FIGS. 1–5 has met technological demands for an acceptable EMI-shielded RJ45 connector jack and connector, where an exteriorly shielded plug is inserted therein, the present invention looks to improve the product in several respects.

SUMMARY OF THE INVENTION

The present invention has as its primary objective the provision of improved EMI shields for electrical connectors.

A particular object of the invention is to provide an improved EMI-shielded RJ45 connector jack and connector.

A quite specific object of the invention is to provide enhanced electrical continuity as between cooperative components of a composite, plural part shield for an electrical connector and to derive cable strain relief from cooperative structures of a stuffer member and a sheet member in an electrical connector.

In attaining the foregoing and other objects, the invention provides, in one aspect, an electrical connector for terminating electrical conductors of a multiconductor cable, the electrical connector comprising an electrically insulative housing defining an passage for receipt of an electrical connector plug and an open interior compartment, a plurality of electrical contacts supported in the housing, the contacts having first portions accessible through the housing passage and second IDC portions resident in the compartment, an electrically conductive sheet member fully circumscribing a part of the housing in which the contact first portions are resident and partly circumscribing the compartment and a stuffer member closing the compartment and dressing electrical conductors into engagement with the contact second IDC portions. The stuffer member has an electrically conductive part in electrical continuity with the sheet member and a stuffer part, the stuffer part being comprised of electrically insulative material, the stuffer member and the sheet member defining structures jointly operating to provide strain relief for the cable.

In another aspect of the invention, the stuffer member and the sheet member define further structures jointly operating to provide electrical continuity between the cable shield and each of the stuffer member and the sheet member.

In a further aspect of the invention, the stuffer member is preferably comprised of a body of electrically insulative material having an uncoated portion defining a stuffer part and a portion coated with an electrically conductive material, the coated portion defining wing members in interference fit with the interior of the sheet member, the stuffer member and the sheet member jointly defining an electrical shield for the electrical connector.

The foregoing and other objects and features of the invention will be further understood from the following detailed discussion of preferred practices and embodiments thereof and from the drawings wherein like reference numerals identify like components and part throughout.

BRIEF DESCRIPTION OF THE DRAWING FIGURES

DETAILED DESCRIPTION OF THE PREFERRED EMBODIMENT(S)

Figure 6:
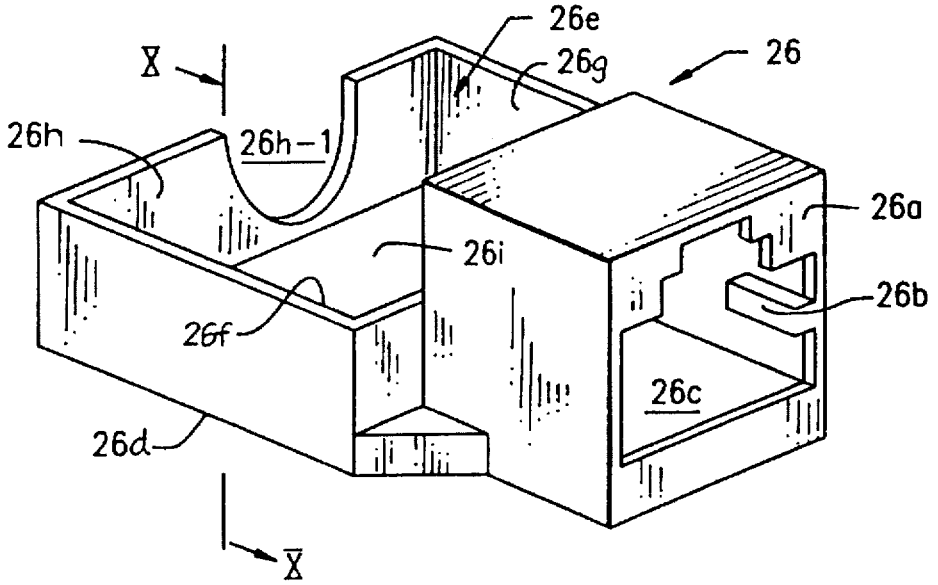
FIG. 6 is a perspective view of a sheet metal shielding member in accordance with the invention.

Referring to FIG. 6, sheet metal member 26 has a box-like portion 26*a*, having interiorly-directed lip 26*b*, resident aside passage 26*c*. A counterpart interiorly-directed lip (not shown) exists on the opposite side of passage 26*c*.

Member 26 further defines a rearward extension 26*d*, which has a top-open compartment 26*e*, with vertically full sidewalls 26*f* and 26*g* and a rear wall 26*h* which is vertically full except for opening 26*h*-1 which is in upper part rectangular and in lower, continuing part, semicircular.

Figure 7:
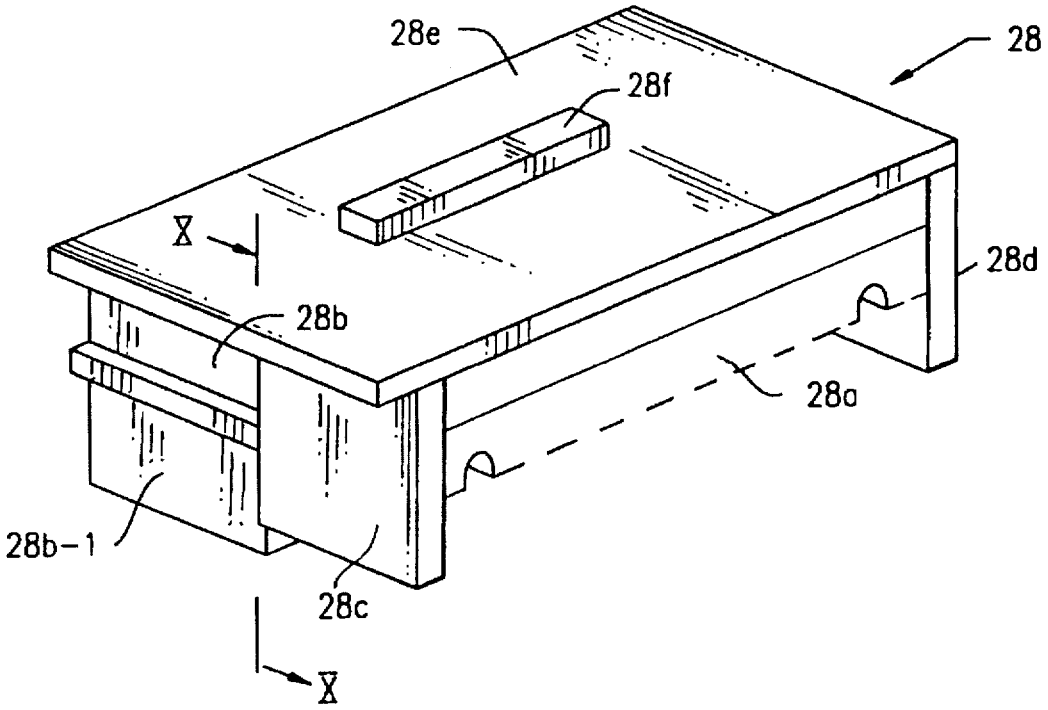
FIG. 7 is a perspective view of a stuffer member shield in accordance with the invention.

Turning to FIG. 7, stuffer member 28 is constituted principally by a body of electrically insulative material. The body has an uncoated part 28*a*, defining the undulations for conductor retention, but the remnant of the body is coated with an electrically conductive substance or substances applied in successive layers.

The body includes a rearward, generally solid portion 28*b*, which supports latch member 28*b*-1 leftwardly thereon, and a counterpart latch member 28*b*-2 (FIG. 9) rightwardly thereon.

Forward sidewalls 28*c* and 28*d* depend from top cover 28*e*, which supports puller member 28*f*, which is useful in disassembly, given the interference fit of components discussed below.

Figure 9:
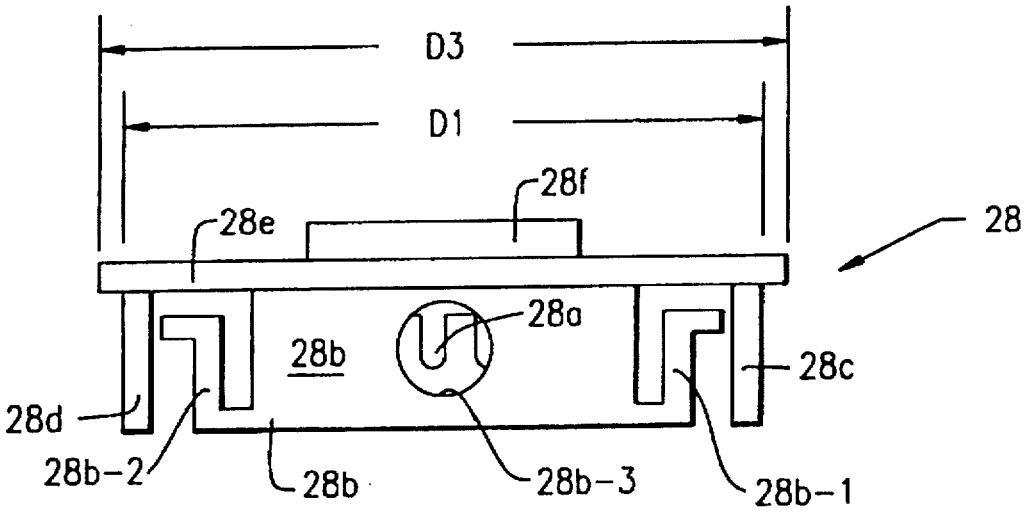
FIG. 9 is rear view of the stuffer member shield of FIG. 7.

Stuffer member 28 further defines a cylindrical passage 28*b*-3 through otherwise solid portion 28*b*, as is seen in FIG. 9.

Figure 8:
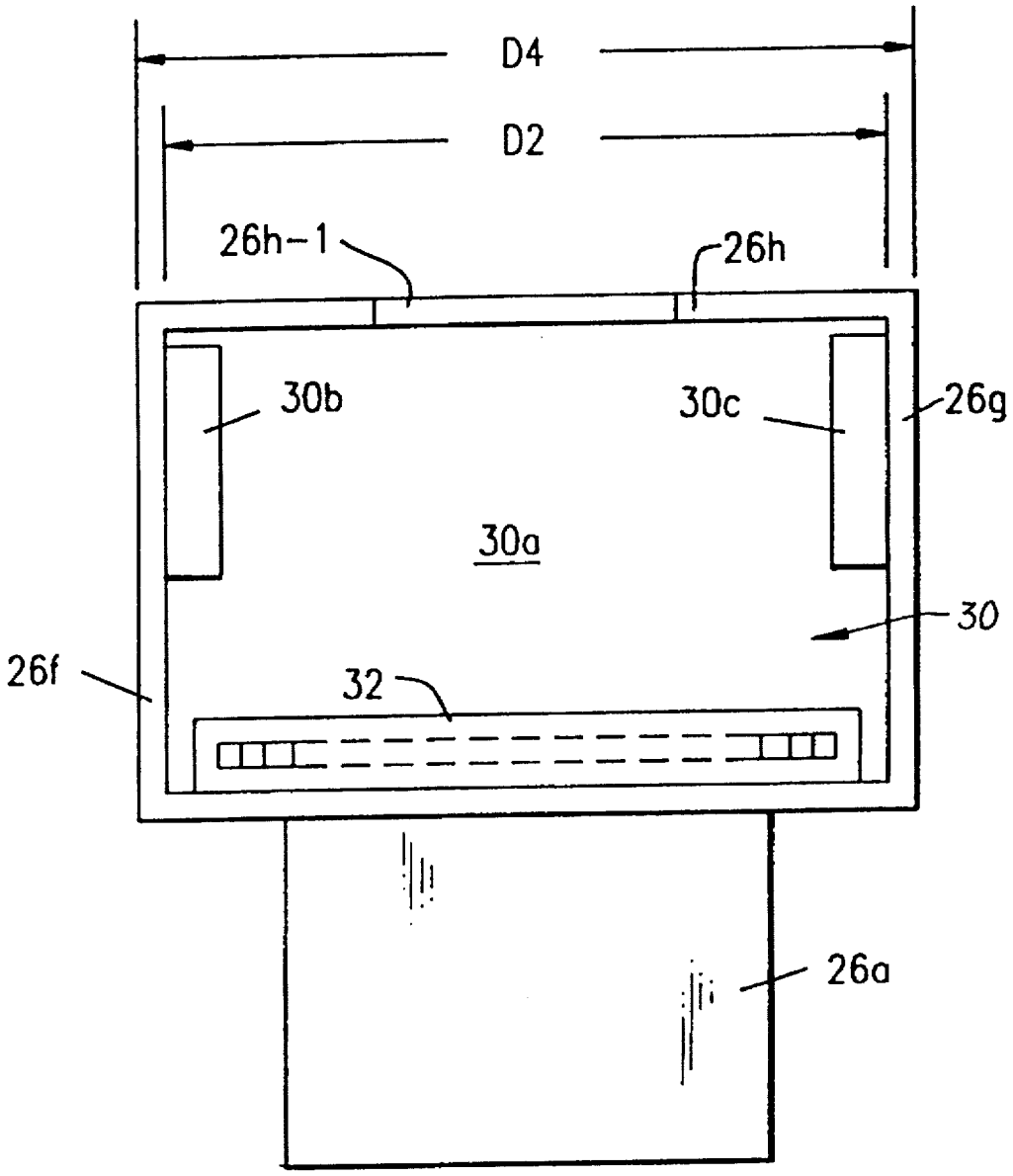
FIG. 8 is a plan view of the sheet metal shielding member of FIG. 6, with a latching IDC conductor terminating member inserted therein.

Dimensioning in accordance with the invention will be understood from the dimension lines shown in FIGS. 8 and 9. Taking first the dimensions D1 and D2, the former is selected to be somewhat greater than the latter, whereby an interference fit will exist as between stuffer member sidewall 28*c* and sheet member sidewall 26*f* and as between stuffer member sidewall 28*d* and sheet member sidewall 26*g*. This dimensional selection gives rise to enhanced electrical continuity as between the stuffer member and the sheet member and enhances mechanical assembly strength above that afforded by latching engagements.

Dimension D3 is made essentially equal to dimension D4, such that outer side extents of the stuffer member and the sheet member are flush with one another.

Figure 10:
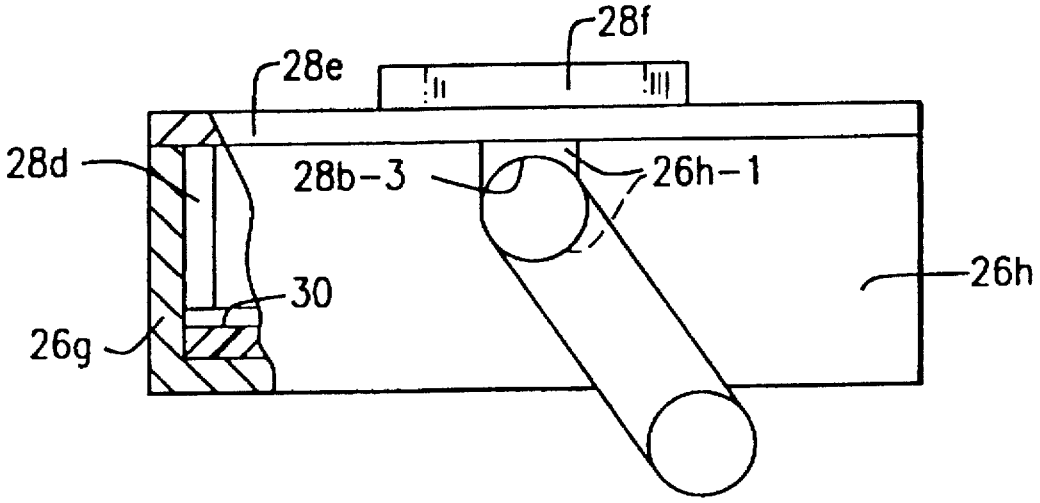
FIG. 10 is a rear view of a connector in accordance with the invention shown in conjunction with a multiconductor cable, partly sectioned at plane X—X of FIGS. 6 and 7.

The radii of the semicircular bottom portion of passage 26*h*-1 and of passage 28*b*-3 are selected to be equal to the nominal radius of cable 12. However, passage 28*b*-3 is so positioned vertically of body portion 28*b* that, on stuffer member insertion, a scissor-type action occurs as between the semicircular bottom portion of passage 26*h*-1 and the upper semicircular portion of passage 28*b*-3. This is illustrated in FIG. 10, wherein the ultimate result is that the respective semicircular portions form a generally elliptical passage with the minor axis of the ellipse being less than the nominal diameter of cable 12, thereby applying strain relief to the cable. Also illustrated in FIG. 10, in the partly sectioned part thereof, is the interference fit as between stuffer member sidewall 28*d* and sheet member sidewall 26*g*.

Figure 2:
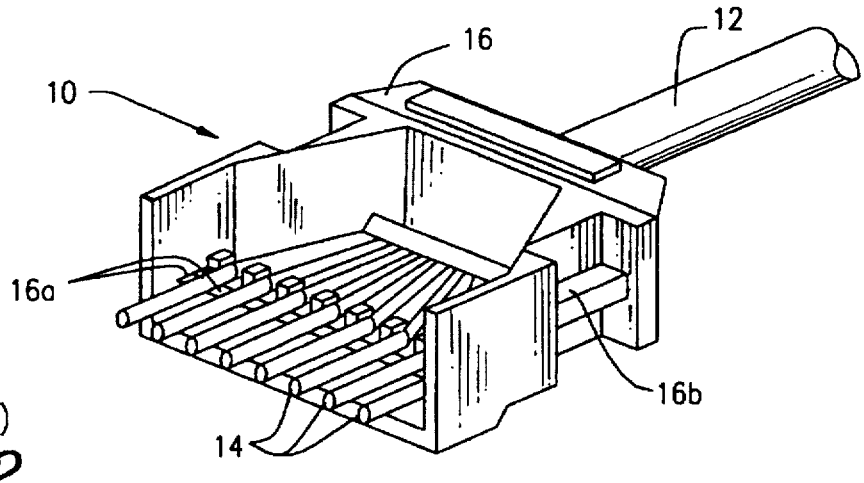
(PRIOR ART) FIG. 2
FIGS. 1–3 are perspective views explaining the structure of the RJ45 electrical connector jack.
Figure 1:
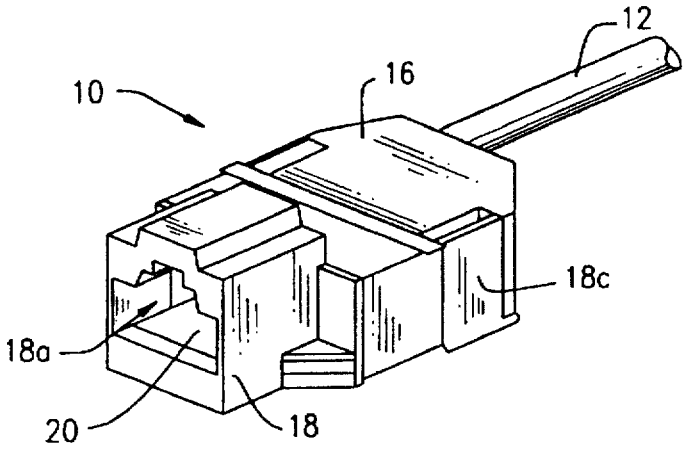
(PRIOR ART) FIG. 1
Figure 3:
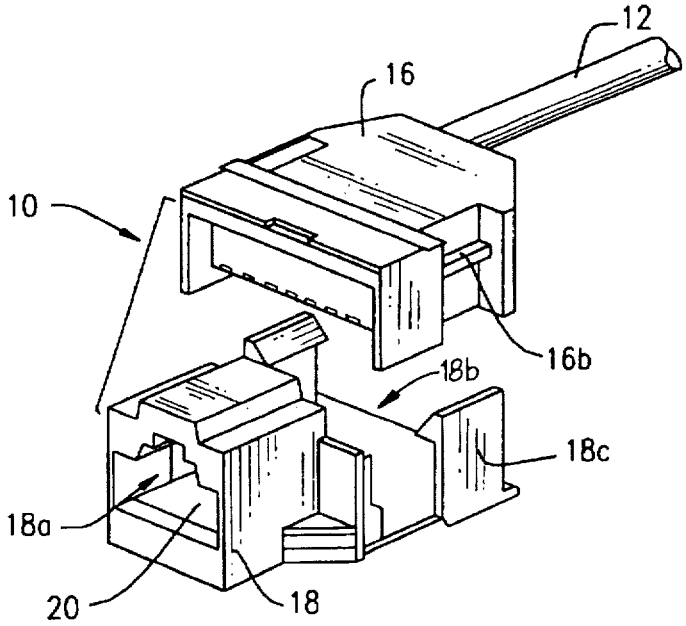
(PRIOR ART) FIG. 3
Figure 4:
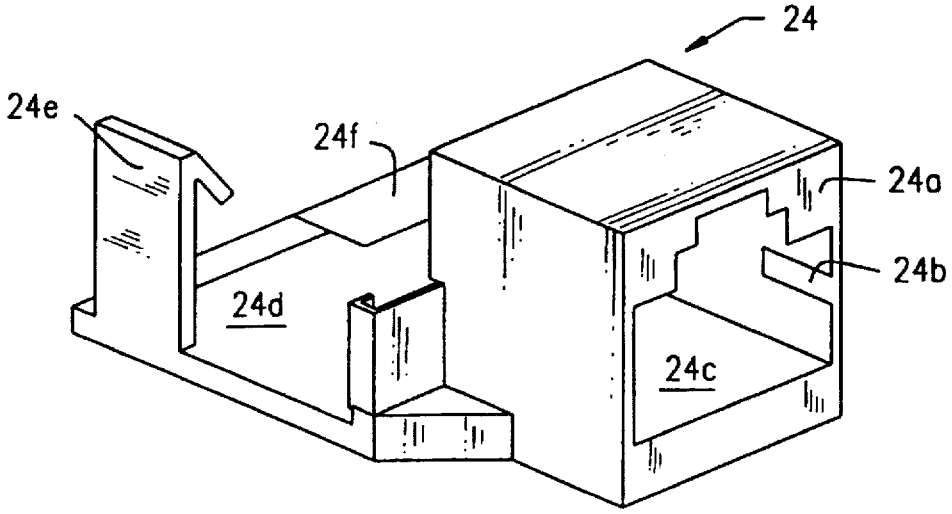
(PRIOR ART) FIG. 4
FIGS. 4 and 5 are perspective views depicting cooperative components of a composite shield for the above-discussed commercial product of the assignee hereof.
Figure 5:
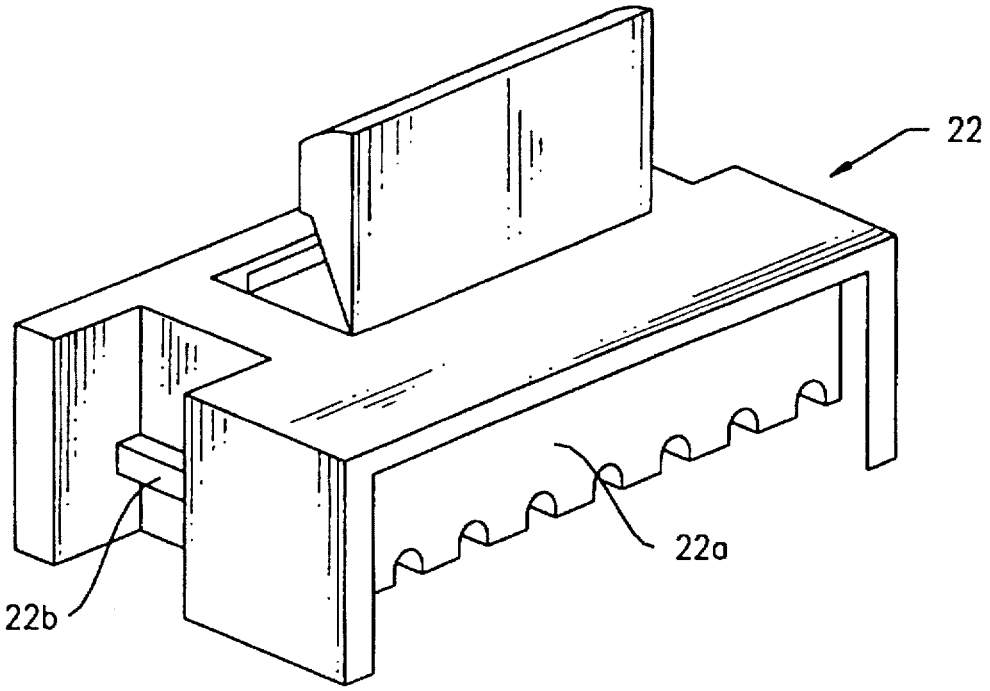
(PRIOR ART) FIG. 5

FIG. 8 illustrates the insulative housing of the connector 30 resident within the top open compartment of sheet metal member 26. Specifically, a bottom portion 30*a* includes thereon upstanding leg porions 30*b*, 30*c* at opposite sides of the compartment. These upstanding leg portions 30*b*, 30*c* fittingly engage solid body portion 28*b* upon insertion of the stuffer member into the compartment. The insulative housing 30 is also illustrated in the partial sectional view of FIG. 10. Similar to the prior art device illustrated in FIGS. 4 and 5 and previously described, the housing 18 with contacts 20 (FIGS. 1 and 3) is inserted into the sheet metal member 26 and generally surrounds the insulative housing 18.

Of consequence to the improved EMI shielding afforded by the arrangement of the invention, it is to be noted that sidewall 26*f* of the sheet member has substantially coextensive surface registration with metal coated surfaces of the stuffer member, i.e., latching member 28*b*-1 and sidewall 28*c*. The same is true as respects sidewall 26*g* and latching member 28*b*-2 and sidewall 28*d*.

As will also be appreciated, the structures latching the connector housing and the stuffer member are fully interiorly disposed relative to the sheet member and the structure retaining the sheet member and the stuffer member are independent of such latching structures.

By way of summary of the foregoing and introduction to the ensuing claims, the invention will be seen to provide, in its preferred embodiment, an upstanding electrical connector for terminating electrical conductors of a multiconductor cable, the electrical connector comprising an elongate electrically insulative housing 18 having a first portion 18*a* defining a passage for receipt of an electrical connector plug and a second portion 30 longitudinally successive to the first portion and defining an interior compartment having open expanse at least vertically of the housing, a plurality of electrical contacts 20 supported in the housing, the contacts having first portions disposed in the housing first portion and accessible through the housing passage and second IDC portions resident in the compartment of the housing second portion, an electrically conductive sheet member 26 having a first portion 26*a* fully circumscribing the housing first portion 18*a* and a second portion 26*e* longitudinally successive to the sheet member first portion 26 and having parts defining opposed longitudinally continuous sidewalls 26*g*, 26*f* and a longitudinally disposed end wall 26*h* for the compartment 26*e*, the end wall 26*h* having a central opening 26*h*-1 therethrough and a stuffer member 28 closing the compartment open expanse and dressing electrical conductors into engagement with the contact second IDC portions, the stuffer member being comprised of electrically insulative material and having a portion thereof coated with electrically conductive material and defining a stuffer member end wall 28*b* with a passage therethrough in longitudinal registry with the sheet member central opening 26*h*-1.

The stuffer member 28 includes a stuffer part 28*a* in registry with the electrical contact second IDC portions in the compartment and has an uncoated portion defining the stuffer part 28*a*, which defines undulations in registry with the electrical contact second IDC portions in the compartment.

The stuffer member portion further defines at least one electrically conductive part 28c, 28d in electrically conductive relation with at least one of the opposed sidewalls of the sheet member 26g, 26f, such part being further in mechanical interference fit relation with the sidewall.

The housing 18 and the stuffer member 28 define first intermatable retention structures for retaining the stuffer member 26 with the housing and the sheet member and the stuffer member define second intermatable retention structures for retaining the stuffer member 28 with the housing.

In a first broader aspect, the invention provides an electrical connector for terminating electrical conductors of a multiconductor cable, the electrical connector comprising an electrically insulative housing 18 defining an passage for receipt of an electrical connector plug and an open interior compartment 30, a plurality of electrical contacts 20 supported in the housing, the contacts having first portions accessible through the housing passage and second IDC portions resident in the compartment, an electrically conductive sheet member 26 fully circumscribing a part of the housing in which the contact first portions are resident and partly circumscribing the compartment and a stuffer member 28 closing the compartment and dressing electrical conductors into engagement with the contact second IDC portions, the stuffer member 28 having an electrically conductive part in electrical continuity with the sheet member and a stuffer part 28a, the stuffer part being comprised of electrically insulative material, the stuffer member and the sheet member defining structures jointly operating to provide strain relief for the cable.

In a second broader aspect, the invention provides an electrical connector for terminating electrical conductors of a shielded multiconductor cable, the electrical connector comprising an electrically insulative housing 18 defining an passage for receipt of an electrical connector plug and an open interior compartment, a plurality of electrical contacts 20 supported in the housing, the contacts having first portions accessible through the housing passage and second IDC portions resident in the compartment, an electrically conductive sheet member 26 fully circumscribing a part of the housing in which the contact first portions are resident and partly circumscribing the compartment and a stuffer member 28 closing the compartment and dressing electrical conductors into engagement with the contact second IDC portions, the stuffer member 28 having an electrically conductive part in electrical continuity with the sheet member and a stuffer part 28a, the stuffer part being comprised of electrically insulative material, the stuffer member and the sheet member defining structures jointly operating to provide electrical continuity between the cable shield and each of the stuffer member and the sheet member.

In a third broader aspect, the invention provides shielded electrical connector for terminating electrical conductors of a shielded multiconductor cable, the electrical connector comprising an electrically insulative housing 18 defining a passage for receipt of an electrical connector plug and an open interior compartment, a plurality of electrical contacts 20 supported in the housing, the contacts having first portions accessible through the housing passage and second IDC portions resident in the compartment, an electrically conductive sheet member 26 fully circumscribing a part of the housing in which the contact first portions are resident and partly circumscribing the compartment and a stuffer member 28 closing the compartment and dressing electrical conductors into engagement with the contact second IDC portions, the stuffer member 28 being comprised of a body of electrically insulative material having an uncoated portion defining a stuffer part 28a and a portion coated with an electrically conductive material, the coated portion defining wing members 28c, 28d in interference fit with the interior of the sheet member, the stuffer member and the sheet member 28 jointly defining an electrical shield for the electrical connector.

Lastly, the invention provides a stuffer member 28 for an electrical connector for use in terminating a shielded electrical multiconductor cable, the stuffer member comprised of a body of electrically insulative material having an uncoated portion defining a stuffer part 28a and a portion coated with an electrically conductive material, the coated portion defining a passage therethrough for the multiconductor cable.

Various changes to the particularly disclosed embodiment and practice may evidently be introduced without departing from the invention. Accordingly, it is to be appreciated that the particularly discussed and depicted embodiment and practice of the invention are intended in an illustrative and not in a limiting sense. The true spirit and scope of the invention are set forth in the ensuing claims.

What is claimed is:

1. An electrical connector for terminating electrical conductors of a multiconductor cable, said electrical connector comprising:

(a) an elongate electrically insulative housing having a first portion defining a passage for receipt of an electrical connector plug and a second portion longitudinally successive to said first portion and defining an interior compartment having open expanse at least vertically of said housing;

(b) a plurality of electrical contacts supported in said housing, said contacts having first portions disposed in said housing first portion and accessible through said housing passage and second insulation displacement connector portions resident in said compartment of said housing second portion;

(c) an electrically conductive sheet member having a first portion fully circumscribing said housing first portion and a second portion longitudinally successive to said sheet member first portion and having parts defining opposed longitudinally continuous sidewalls and a longitudinally disposed end wall forming a substantially box-like receiving portion of said interior compartment, said end wall having a central opening therethrough; and (d) a stuffer member for closing said interior compartment open expanse and dressing electrical conductors into engagement with said contact second insulation displacement connector portions, said stuffer member being comprised of electrically insulative material and having a portion thereof coated with electrically conductive material, the stuffer member further including an rear wall with an opening therethrough in longitudinal registry with said sheet member U-shaped central opening, wherein the stuffer member includes a top portion and opposed longitudinal sidewalls depending from said top portion, said sidewalls of said stuffer member being coated with electrically conductive material and being in interference fit relationship with the longitudinal continuous sidewalls of the sheet member thereby providing electrical continuity between said stuffer member and sheet member for shielding against electromagnetic interference.

2. The connector claimed in claim 1, wherein said stuffer member includes a stuffer part in registry with said electrical contact second insulation displacement connector portions in said compartment.

3. The connector claimed in claim 2, wherein said stuffer member has an uncoated portion defining said stuffer part.

4. The connector claimed in claim 3, wherein said stuffer part defines undulations in registry with said electrical contact second displacement connector portions in said compartment.

5. The connector claimed in claim 1, wherein said housing and said stuffer member define intermatable retention structures for retaining said stuffer member with said housing.

6. The connector claimed in claim 1, wherein said sheet member and said stuffer member define intermatable retention structures for retaining said stuffer member with said housing.

7. The connector claimed in claim 1, wherein said housing and said Stuffer member define first intermatable retention structures for retaining said stuffer member with said housing and wherein said sheet member and said stuffer member define second intermatable retention structures for retaining said stuffer member with said housing.

8. The connector claimed in claim 1, wherein said stuffer member rear wall opening and said sheet member U-shaped opening define structure jointly operating to provide a scissor-type action therebetween for holding said cable thereby providing strain relief for said cable.

9. An electrical connector jack for terminating electrical conductors of a multiconductor cable, said electrical connector jack comprising:

(a) an electrically insulative housing defining a passage for receipt of an electrical plug and an open interior compartment;

(b) a plurality of electrical contacts supported in said housing, said contacts having first portions accessible through said housing passage and second insulation displacement connector portions resident in said compartment;

(c) an electrically conductive sheet member fully circumscribing a part of said housing in which said contact first portions are resident and partly circumscribing said compartment, the sheet member including opposed sidewalls and a longitudinally disposed end wall, said end wall having a substantially U-shaped central opening therethrough; and (d) a stuffer member closing said compartment and dressing electrical conductors into engagement with said contact second insulation displacement connector portions, said stuffer member having an electrically conductive part in electrical continuity with said sheet member and a stuffer part, said stuffer part being comprised of electrically insulative material, said stuffer member including a top wall and a rear wall depending from said top Wall, said rear wall including a substantially circular opening for receiving said cable, wherein, said stuffer member rear wall opening and said sheet member U-shaped opening define structures jointly operating to provide a scissor-type action therebetween for holding said cable thereby providing strain relief for said cable.

10. A shielded electrical connector jack for terminating electrical conductors of a shielded multiconductor cable, said electrical connector jack comprising:

(a) an electrically insulative housing defining a passage for receipt of an electrical connector plug and an open interior compartment;

(b) a plurality of electrical contacts supported in said housing, said contacts having contact ends accessible through said housing passage and termination portions resident in said compartment;

(c) an electrically conductive sheet member fully circumscribing a part of said housing in which said contact ends are resident and partly circumscribing said compartment; and (d) a stuffer member closing said compartment and dressing electrical conductors into engagement with said contact termination portions, said uncoated portion defining a stuffer part and a portion coated with an electrically conductive material, said coated portion defining wing members in interference fit relationship with said sheet member portion circumscribing said compartment, said stuffer member wing members and said sheet member being in electrical communication and jointly defining an electrical shield for said electrical connector jack;

wherein said stuffer member includes a top wall and a rear wall depending from said top wall, said rear wall including a substantially circular opening for receiving said cable, wherein said sheet member includes opposed sidewalls and a longitudinally disposed end wall, said end wall having a substantially U-shaped central opening therethrough, such that said stuffer member rear wall opening and said sheet member U-shaped opening define structure jointly operating to provide a scissor-type action therebetween for holding said cable thereby providing strain relief for said cable.

11. The connector claimed in claim 10, wherein the cable includes a cable shield, and said cable shield is in electrical communication with the electrical shield.

* * * * *